United States Patent [19]

Williams

[11] Patent Number: 4,712,265

[45] Date of Patent: Dec. 15, 1987

[54] DEVICE FOR CLEANING THE HUMAN BODY

[76] Inventor: Kenneth A. Williams, 217 Milner Rd., South Claremont, Cape Town, Cape Province, South Africa

[21] Appl. No.: 820,950

[22] Filed: Jan. 21, 1986

[30] Foreign Application Priority Data

Jan. 24, 1985 [ZA] South Africa ..... 85/0584
Jun. 4, 1985 [ZA] South Africa ..... 85/4226

[51] Int. Cl.[4] ..... A47K 7/04

[52] U.S. Cl. ..... 15/97 R; 15/21 D; 4/606; 128/56

[58] Field of Search ..... 15/21 R, 21 C:21 D, 15/21 E, 28, 97 R, 230.16; 4/606; 128/56

[56] References Cited

U.S. PATENT DOCUMENTS 2,657,685 11/1953 Holland ..... 4/606
3,106,732 10/1963 Dayton et al. ..... 128/56 X
3,802,420 4/1974 Moffat ..... 15/28
4,046,142 9/1977 Whitney ..... 128/56
4,566,911 1/1986 Tomita ..... 15/230.16

FOREIGN PATENT DOCUMENTS 2429808 1/1976 Fed. Rep. of Germany ..... 128/56
685891 3/1965 Italy ..... 15/97 R

*Primary Examiner*—Edward L. Roberts
*Attorney, Agent, or Firm*—Ladas & Parry

[57] ABSTRACT

A cleaning device, which also has massaging capabilities, and which includes a housing with a drive motor or water driven turbine in it, a pair of brushes or generally cylindrical sponge pads which are on opposite ends of a shaft, and a transmission connecting the shaft to the drive motor or turbine. The shaft is in a vertical tube which forms the 'cross-bar' of a T-shaped structure, a further tube forming the 'upright' of the T-shaped structure and extending horizontally from the housing. The transmission is in this further tube. Each cleaning pad can be ribbed, the ribs of the two pads being out of alignment. In the preferred form the device is a bathroom fitting.

10 Claims, 7 Drawing Figures

DEVICE FOR CLEANING THE HUMAN BODY

This invention relates to a device for cleaning the human body.

According to one aspect of the present invention there is provided a device for cleaning the human body, the device comprising a casing structure, drive means within the casing structure, at least one rotatable cleaning means for engagement with the body of a person using the device, and a transmission connecting the drive means to the cleaning means so that the cleaning means is rotated by the drive means.

In one form the drive means comprises an electric motor and the transmission comprises a drive band entrained around an output shaft of the motor and around a further shaft on which the cleaning means is mounted. In another form the drive means comprises a water driven turbine and the transmission comprises a drive band entrained around an output shaft of the turbine and around a further shaft on which the cleaning means is mounted.

Preferably the cleaning means is a generally cylindrical pad of sponge which has a series of axially extending, circumferentially spaced ribs.

In a specific construction said cleaning means comprises two pads which are spaced apart along a common axis, the ribs of one pad being out of alignment with the ribs of the other pad.

In this specific construction said casing structure can comprise a housing containing said drive means, a first tubular element protruding horizontally from said housing and a second tubular element transverse to the first tubular element and at the end of the first element remote from the housing, there being a shaft in said second tubular element and said transmission passing through the first tubular element and joining said shaft to said drive means, there being a pad at each end of said shaft.

To provide a supply of soap to the pads each pad can have a sleeve therein, and there can be tubular containers at each end of said shaft, said tubular containers serving to contain liquid soap and entering said sleeves when the pads are mounted on said shaft, there being registering openings in the sleeves and tubular containers so that soap can flow into the pads.

According to a further aspect of the present invention there is provided cleaning means comprising a hollow sleeve having openings in the wall thereof and a generally cylindrical sponge pad which has a central opening in which said sleeve fits, said pad having a series of axially extending circumferentially spaced ribs.

Desirably the outer face of said pad comprises a circumferentially spaced series of concave, part-cylindrical surfaces alternating with convex part-cylindrical surfaces, the concave surfaces being of greater circumferential extent than the convex surfaces which latter surfaces form the outer faces of the ribs.

For a better understanding of the present invention, and to show how the same may be carried into effect, reference will now be made, by way of example, to the accompanying drawings in which.

Figure 1:
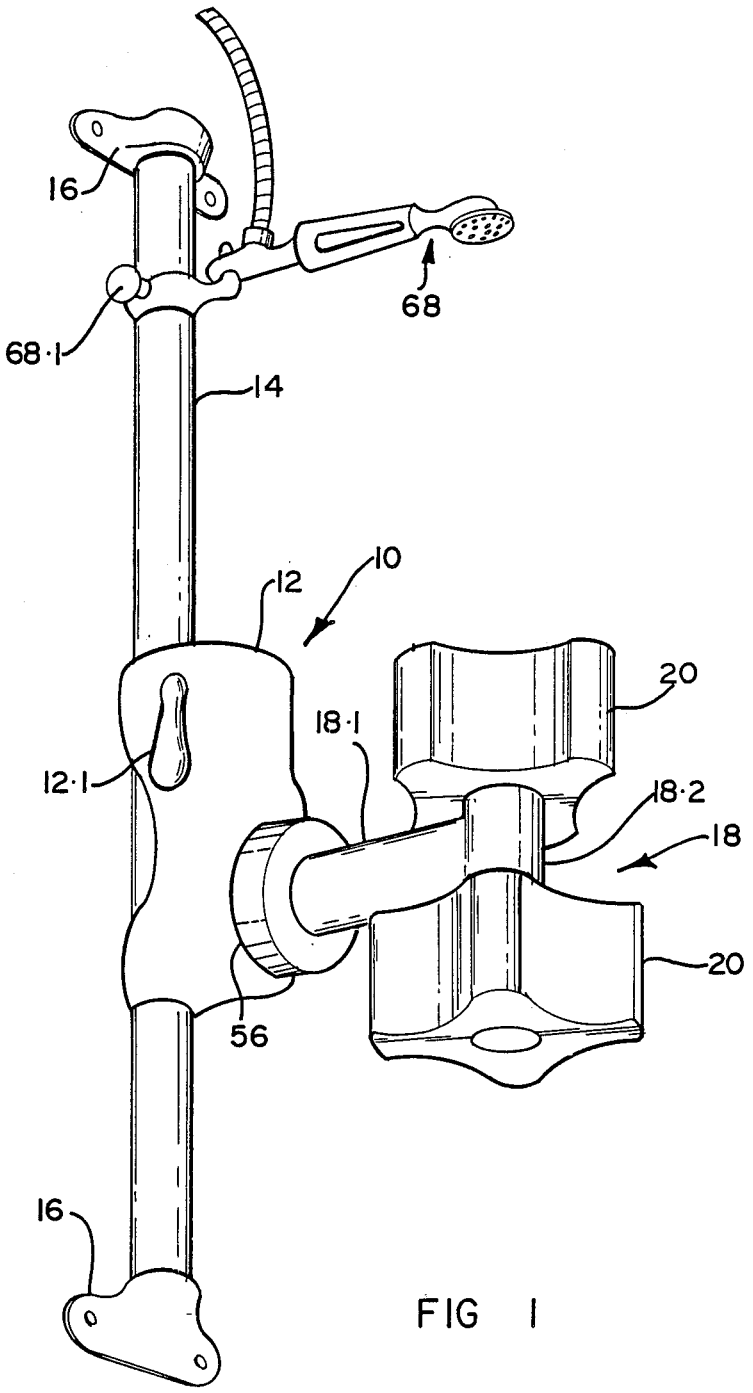
FIG. 1 is a pictorial view of a device for cleaning the human body, the device being in the form of a bathroom fitting.

Referring firstly to FIG. 1, the fitting illustrated includes a casing structure designated 10 which itself comprises a motor housing 12 which can be moved vertically on a shaft 14, the shaft 14 itself being mounted on a wall by means of brackets 16. The mountings of the shaft 14 are described in more detail hereinafter with reference to FIG. 7. The casing structure 10 further comprises a T-shaped construction 18 which protrudes from the housing 12. The longer limb 18.1 of the construction 18 is in the form of a horizontal tubular element and the shorter limb 18.2 thereof is transverse to the limb 18.1 and is also in the form of a tubular element. Cleaning means in the form of rotatable sponge pads 20 are mounted at the upper and lower ends of the vertical limb 18.2 of the construction 18. The pads 20 can be of natural sponge or of artificial sponge i.e. of foamed synthetic plastics material.

Figure 2:
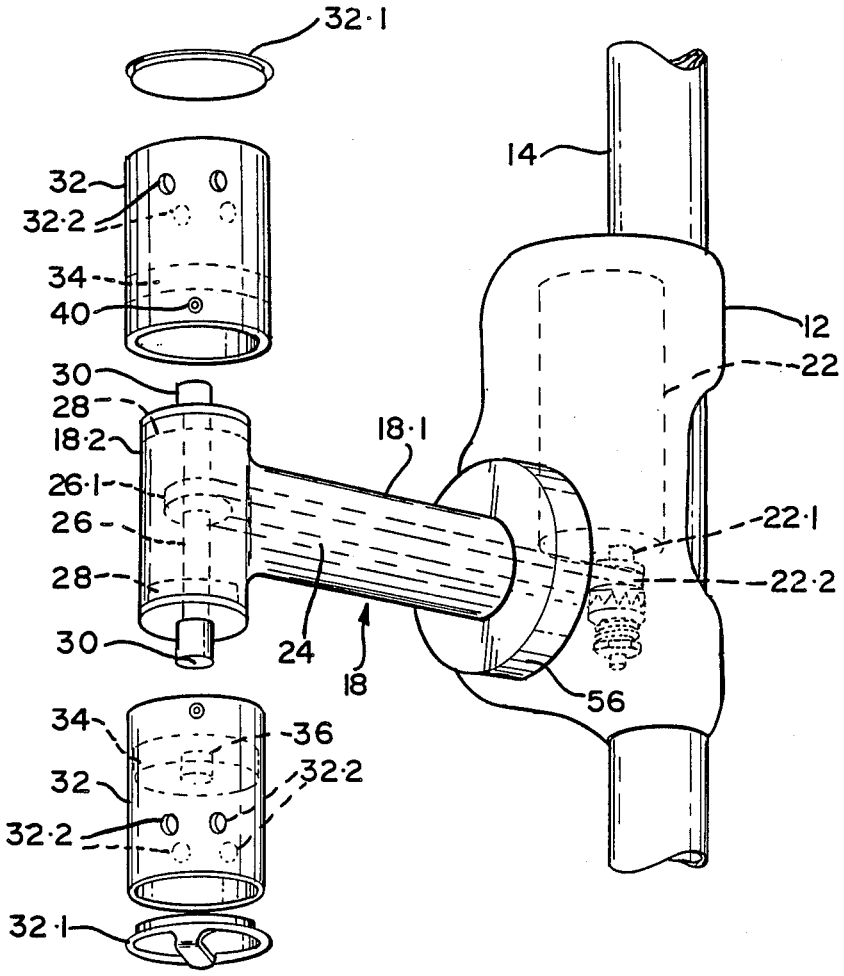
FIG. 2 is a view similar to that of FIG. 1 but showing the fitting 'exploded' and with certain parts omitted.

Referring now to FIG. 2, a low voltage electric motor 22 is mounted vertically in the housing 12. The output shaft 22.1 of the motor 22 carries a toothed pulley 22.2 about which a toothed belt 24 is entrained. The belt 24 passes through the horizontal limb 18.1 of the tubular construction 18 and is entrained around a toothed pulley 26.1 carried by a vertical shaft 26. The shaft 26 is mounted in bearings 28 carried in the upper and lower ends of the vertical limb 18.2 of the tubular construction 18. Drive spigots 30 are provided at each end of the shaft 26, the spigots 30 protruding from the upper and lower ends of the vertical limb 18.2.

Short tubes 32 are provided above and below the limb 18.2, the upper tube 32 having a disc 34 press fitted into it near the lower end thereof and the lower tube having a similar disc 34 press fitted into it near the upper end thereof. Each tube and associated disc can, of course, be integral with one another if desired.

The discs 34 each have an aperture 36 therein and the spigots 30 are tight fits in these apertures. Once pressed onto the spigots 30, the tubes 32 are not thereafter removed during normal use. The ends of the tubes 32 remote from the discs 34 are closed by snap-fitting, pressed-in or screwed-in end caps 32.1. The tubes 32 each have a ring of openings 32.2 therein and each tube 32 additionally has a stud 40 protruding outwardly therefrom. The tubes 32 thus constitute tubular containers at each end of the shaft 26.

Figure 4:
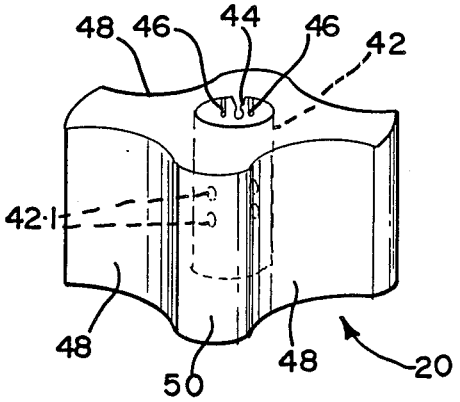
FIG. 4 illustrates a cleaning pad of the fitting.

Each pad 20 is mounted on a sleeve 42 (FIG. 4). The sleeve 42 has a keyhole slot 44 at one end thereof, and a slit 46 on each side of the slot 44. Each sleeve 42 is pushed onto the respective tube 32 with the end in which the slot 44 is formed leading. The stud 40 enters the slot 44 and opens the slot out before entering the circular hole at the closed end of the slot. This releasably secures the sleeve 42 to the tube 32. Finger pressure in the axial direction is sufficient to release the sleeve 42 from the tube 32. It will be understood that the sleeves 42 and pads 20 extend slightly beyond the tubes 32 towards the limb 18.1 so that the mounting arrangement thereof is entirely hidden (see FIG. 1).

Each sleeve 42 has a ring of openings 42.1 therein, the openings 42.1 and 32.2 registering with one another.

Each pad 20 consists of, for example, foamed plastics which is suitably secured to the sleeve 42. For example, the foamed plastics can be punched with a central aperture which receives the sleeve 42. A suitable adhesive between the sleeve 42 and the foamed material secures it to the sleeve.

Each pad 20 has four concave part cylindrical surfaces 48 which alternate with four convex part-cylindrical surfaces 50. The surfaces 48 are of greater circumferential extent than the surfaces 50 which latter surfaces form the outer faces of four axially extending ribs. As shown in FIG. 1, the upper pad 20 is forty five degrees offset with respect to the lower pad so that the ribs of the upper and lower pads are not aligned.

Figure 3:
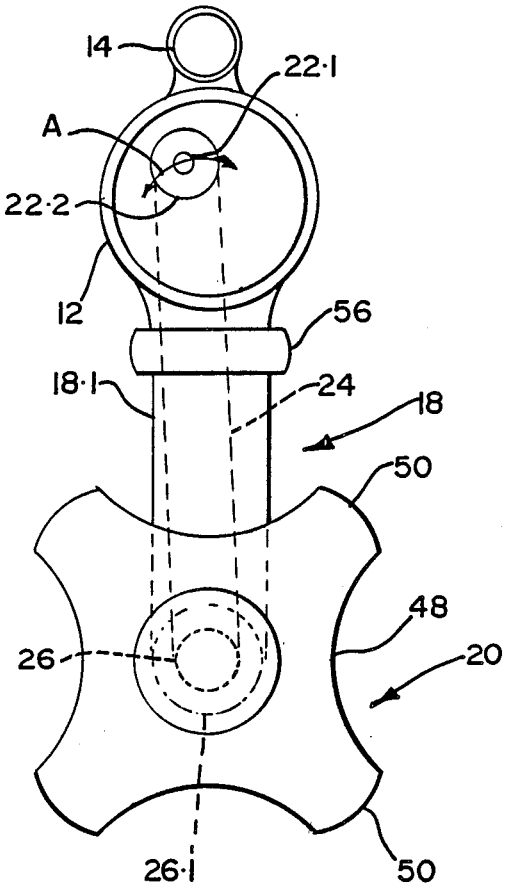
FIG. 3 is a top plan view of the bathroom fitting.

The drive shaft 22.1 of the motor 22 is not co-axial with the motor 22 as can be seen from FIGS. 2 and 3. By rotating the motor 22 in its housing 12 (as shown by arrow A in FIG. 3), the belt 24 can be tensioned or slackened.

Figure 5:
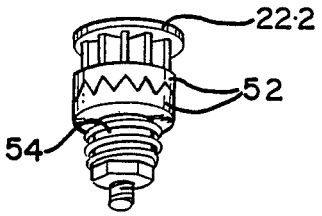
FIG. 5 illustrates a clutch.

The pulley 22.2 is preferably incorporated into a slipping clutch (see FIG. 5) so that drive from the motor is disconnected if rotation of the pads 20 should be stopped. The clutch can comprise two toothed clutch plates 52 urged into face-to-face contact by a spring 54. The plates move apart against spring action if the pads 20 are stalled.

The motor housing 12 can be rotated about the vertical axis of the shaft 14 and also moved along the shaft 14. The mechanism for locking the housing 12 to the shaft 14 can be of any suitable type. In FIG. 1 a lever 12.1 is shown for locking the housing 12 to, and unlocking it from, the shaft 14. A suitable locking mechanism comprises a band which passes around the shaft 14 and which is pulled tight when the lever 12.1 is in one end position and is slackened as the lever is moved to its other end position.

Figure 7:
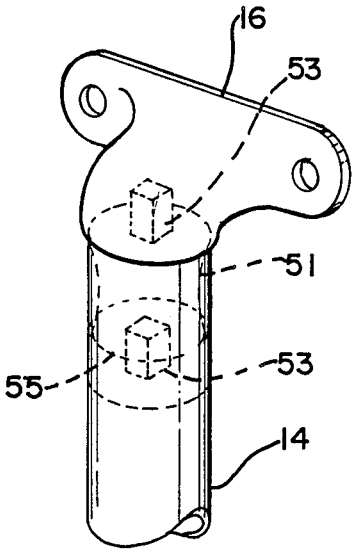
FIG. 7 illustrates a torsion mounting.

The upper and lower ends of the shaft 14 are mounted by means of resilient e.g. rubber bushes 51 (see FIG. 7) which permit limited motion of the shaft 14 with respect to the brackets 16, resistance to movement increasing as the shaft 14 rotates. As illustrated in FIG. 7 square section stub shafts 53 protrude in opposite directions from the bush 51. The shaft 14 has a disc 55 push fitted therein, the disc having a square central hole. The bracket also includes a square hole. The shafts 53 push into the holes in the disc 55 and the bracket. Thus one end of each bush is retained against rotation by the bracket, the other end rotating with the shaft 14.

Figure 6:
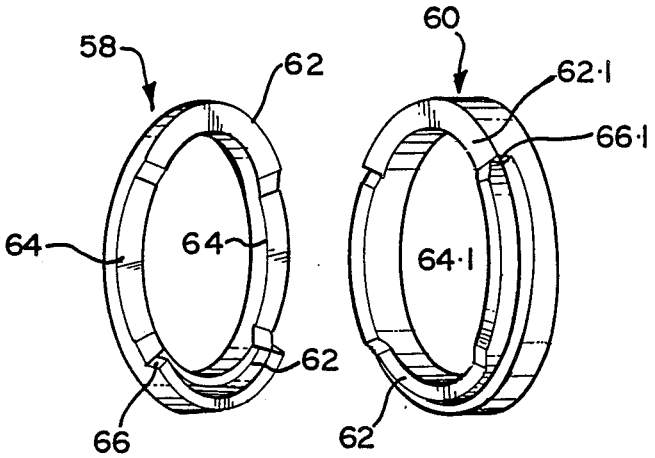
FIG. 6 illustrates two length adjusting components.

A clamping ring 56 is carried by the motor housing 12 and encircles the horizontal limb 18.1 of the construction 18. When the ring 56 is loosened, the construction 18 can be turned through 90 degrees in either direction from the position illustrated in FIG. 1 so that the pads 20 rotate about a horizontal rather than a vertical axis. It will be understood that the shafts 22.1 and 26 are then at right angles to one another and the belt 24 is twisted. The clamping rings 58 and 60 of FIG. 6 are carried one by the housing 12 and the other by the construction 18 and are within the ring 56. The ring 58 has two raised arcuate sections 62 and two depressed sections 64. A stop 66 is also provided. The ring 60 is similar to the ring 58 and includes sections 62.1 and 64.1 as well as a stop 66.1.

The raised sections 62, 62.1 are in face-to-face contact while the construction 18 is in the position shown in FIG. 1. The rings 58, 60 are thus at their greatest spacing and the belt 24 is untwisted. When the construction 18 is turned through 90 degrees, the sections 62, 62.1 seat in the depressed sections 64, 64.1 so that the rings move together. This has the effect of shifting the shaft 26 towards the shaft 22.1 to compensate for the fact that the effective length of the belt 24 is decreased as it is twisted.

The stops 66, 66.1 limit the total permitted rotational movement of the construction 18.1 to 180 degrees.

A shower head is shown at 68 in FIG. 1. This includes a collar through which the shaft 14 passes and a thumb screw 68.1 which serves releasably to secure the collar to the shaft.

If desired the motor can be supplied from rechargable cells incorporated into the housing 12.

In use of the fitting, it is secured to the wall of a shower or to the wall of the bathroom over the bath. A low voltage supply is connected to the motor 22. When the motor is switched on, drive is transmitted therefrom through the belt 24 to the shaft 26 and then to the pads 20. The user presses his back against the pads 20 for the purpose of cleaning his back. If pads of the form shown in the drawings are used, a massaging effect is also obtained.

By means of the locking mechanism described, the entire motor housing, and hence the pads 20, can be freed and then shifted vertically on the shaft 14 to enable different parts of the body to be reached. If the force exerted on the fitting 10 by the user when he presses back is not along the axis of the horizontal limb 18.1 of the construction 18, then the entire housing 12 and shaft 14 tend to turn in the brackets 16 against the resistance offered by the rubber bushes 51.

The shower head 68 can be moved up and down the shaft 14 so that the water from the shower head 68 always flows onto the pads 20. Thus should the fitting be lowered for use on the legs or lower body, the shower head 68 can itself be lowered so as to provide water in the region being cleaned.

By loosening the clamping ring 56, the tubular construction 18 can be rotated about its horizontal axis so that the pads 20 lie side-by-side on a horizontal axis. By alternately bending and straightening his knees, the user can cause the pads 20 to run up and down a large portion of his back.

The caps 32.1 can be removed and the tubes 32 filled with liquid soap. Centrifugal force throws the soap outwardly through the registering holes 32.2 and 42.1 into the pads 20.

In an alternative form which has not been illustrated, the motor 22 is replaced by a turbine. If necessary a pump can be provided for supplying water at a pressure which is sufficiently high to drive the turbine.

If desired the housing 12, construction 18 and pads 20 can form part of a hand held unit rather than part of a wall fitting. In this form re-chargable cells can be incorporated into the housing 12.

The pads 20 can be replaced by brushes the bristles of which clean the body. No significant massaging effect is obtained when brushes are employed.

What is claimed is:

1. A device for cleaning the human body, the device comprising a casing structure, drive means within the casing structure, first and second generally cylindrical cleaning pads for engagement with the body of a person using the device, said pads being spaced apart along a common longitudinal axis, each pad being of sponge and each having a series of axially extending circumferentially spaced ribs, the ribs of one pad being out of alignment with the ribs of the other pad, and transmission means connecting the drive means to the cleaning means so that said pads are rotated about said common axis.

2. A device as claimed in claim 1, wherein said casing structure comprises a housing containing said drive means, a first tubular element protruding horizontally from said housing and a second tubular element transverse to the first tubular element and at the end of the first element remote from the housing, there being a shaft in said second tubular element and said transmission passing through the first tubular element and joining said shaft to said drive means, there being a pad at each end of said shaft.

3. A device as claimed in claim 2, wherein each pad has a sleeve therein, and wherein there are tubular containers at each end of said shaft, said tubular containers serving to contain liquid soap and entering said sleeves when the pads are mounted on said shaft, there being registering openings in the sleeves and tubular containers so that soap can flow into the pads.

4. A device as claimed in claim 2, wherein said first tubular element is rotatable with respect to the housing about the axis thereof whereby said second tubular element and said shaft can be displaced between vertical and horizontal positions.

5. A wall mounted device for cleaning the human body, the device comprising a casing structure, drive means within the casing structure, at least one rotatable cleaning means for engagement with the body of the person using the device, a transmission connecting the drive means in the casing structure to the cleaning means so that the cleaning means is rotated by the drive means, a vertically extending support on which said casing structure is mounted and along which the casing structure can be moved in the vertical direction, mountings for attaching said support to a wall, said mountings including torsion means for permitting said support to rotate about a vertical axis against the resistance offered by such means when the user exerts sufficient force on said cleaning means to turn said vertical support about said vertical axis.

6. A device according to claim 5, and including a construction which is rotatable about a horizontal axis with respect to said casing structure, said cleaning means being carried by said construction and comprising first and second cleaning pads of cylindrical form, said pads being spaced apart along a common axis of rotation which is at right angles to said horizontal axis.

7. A device according to claim 6, and including means for releasably locking said casing structure to said vertical support, said locking means preventing said casing structure moving with respect to said vertical support while it is in the locked position.

8. A device according to claim 6, in which said transmission means includes a belt entrained around a drive pulley and around a driven pulley, an electric motor within said casing structure and driving said drive pulley, a shaft carried by said construction, said driven pulley driving said shaft and the cleaning means being on said shaft, and means for varying the distance between the axes of rotation of said pulleys as said construction is rotated with respect to casing structure thereby twisting and untwisting said belt.

9. A device according to claim 5, and including a tubular container for receiving liquid soap, said tubular container forming part of said transmission means and said cleaning means having a hollow interior which receives said container, there being registering holes in said cleaning means and said container whereby on rotation of the container liquid soap flows outwardly from the container through the registering holes and into the cleaning means.

10. A device according to claim 9, in which said cleaning means comprises a sleeve which is within a central aperture of a pad of foamed plastic material, said sleeve having holes in it which register with holes in said tubular container.

* * * * *